US006536396B1

(12) United States Patent
Robinson et al.

(10) Patent No.: US 6,536,396 B1
(45) Date of Patent: Mar. 25, 2003

(54) STARTING DEVICE FOR INTERNAL COMBUSTION ENGINES

(75) Inventors: Brian W. Robinson, Dickson, TN (US); William J. McMaster, Berkeley Heights, NJ (US); Walter H. Marsh, Scotch Plains, NJ (US); Mark Minnichelli, Califon, NJ (US); Frank P. Aadahl, Bound Brook, NJ (US); Roy Oppedisano, Pequannock, NJ (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 09/588,907

(22) Filed: Jun. 7, 2000

Related U.S. Application Data

(60) Provisional application No. 60/138,204, filed on Jun. 9, 1999.

(51) Int. Cl.[7] ..... F02N 3/02

(52) U.S. Cl. ..... 123/185.3; 74/140

(58) Field of Search ..... 123/185.2, 185.3, 123/185.4; 74/139, 140

(56) References Cited

U.S. PATENT DOCUMENTS

| | | | | |
|---|---|---|---|---|
| 1,051,807 A | * | 1/1913 | Eckhart | 123/185.3 |
| 1,644,932 A | * | 10/1927 | Mack | 123/185.3 |
| 2,323,535 A | * | 7/1943 | Gorden | 123/185.3 |
| 4,582,030 A | | 4/1986 | Reese | 123/185 B |
| 4,615,311 A | | 10/1986 | Scheckel | 123/179 P |
| 4,637,360 A | | 1/1987 | Osakabe | 123/185 A |
| 4,658,775 A | | 4/1987 | Greenwood et al. | 123/185 B |
| 4,662,158 A | | 5/1987 | Zerrer | 56/12.7 |
| 4,732,121 A | | 3/1988 | Miyata et al. | 123/185 BA |
| 4,841,929 A | | 6/1989 | Tuggle et al. | 123/198 E |
| 4,850,233 A | | 7/1989 | Ishigo | 74/6 |
| 4,909,201 A | | 3/1990 | Nagashima et al. | 123/185 BA |
| 4,928,643 A | | 5/1990 | Kampichler et al. | 123/185 B |
| 4,940,028 A | | 7/1990 | Tuggle | 123/185 B |
| 4,970,998 A | | 11/1990 | Tyler | 123/185 B |
| 5,014,657 A | | 5/1991 | Tsunakawa et al. | 123/185 B |
| 5,065,710 A | | 11/1991 | Henriksson | 123/185 B |
| 5,067,451 A | | 11/1991 | Tyler | 123/185 BA |
| 5,163,393 A | | 11/1992 | Naslund | 123/185.3 |
| 5,267,540 A | | 12/1993 | Zerrer et al. | 123/185.3 |
| 5,287,832 A | | 2/1994 | Uhl | 123/185.3 |
| 5,329,896 A | | 7/1994 | Everts | 123/185.3 |
| 5,333,580 A | | 8/1994 | Hopkins | 123/185.3 |
| 5,361,738 A | | 11/1994 | Iida | 123/182.1 |
| 5,379,734 A | | 1/1995 | Tsunoda et al. | 123/182.1 |
| 5,431,135 A | | 7/1995 | Tyler | 123/185.3 |
| 5,483,931 A | | 1/1996 | Stoll et al. | 123/185.3 |
| 5,513,607 A | | 5/1996 | Doragrip et al. | 123/185.3 |
| 5,544,630 A | | 8/1996 | Koga | 123/185.3 |
| 5,676,103 A | | 10/1997 | Tsunoda et al. | 123/185.3 |
| 5,715,783 A | | 2/1998 | Osakabe et al. | 123/185.3 |
| 5,765,438 A | | 6/1998 | Chang | 74/6 |
| 6,253,722 B1 | * | 7/2001 | Robinson et al. | 123/185.2 |

OTHER PUBLICATIONS

U.S. Statutory Invention Registration No. H517 Sato et al. 9/98.

* cited by examiner

*Primary Examiner*—Andrew M. Dolinar
(74) *Attorney, Agent, or Firm*—Roger H. Criss

(57) ABSTRACT

A starting device has a strip connected to a pulley for a pull start mechanism. The strip is composed of a high performance plastic and is provided with an integral handle. A connection means connects the strip to the pulley on its distal end. The strip fits neatly in a coil around a pulley hub. It lays flat during storage and exerts substantially no lateral pressure against the walls of the pulley. With this construction, the strip does not fray and affords a storing mechanism that is cleaner than a conventional rope system. The starting device has few parts and is easy to assemble. It is lightweight, inexpensive to construct and facilitates starting in an efficient, reliable manner.

11 Claims, 3 Drawing Sheets

STARTING DEVICE FOR INTERNAL COMBUSTION ENGINES

CROSS-REFERENCE TO RELATED APPLICATIONS

This application claims the benefit of U.S. provisional patent application Ser. No. 60/138,204, filed Jun. 9, 1999.

BACKGROUND OF THE INVENTION

1. Field of the Invention

This invention relates to a starting device for internal combustion engines; and more particularly to a starter strip operable to initiate movement of the drive shaft of a small engine during starting.

2. Description of the Prior Art

Starting mechanisms for internal combustion engines, for example small engines used in lawn and power applications, and even smaller engines designed for model planes and the like, need improvement. These mechanisms are typically of the rope and pulley type, and when used present the manufacturer and user numerous problems.

Some of the problems presented by conventional starting mechanisms include broken rope, tangled rope, spreading of the pulley sides, inconsistent pulls, jamming of the rope, wear on the rope, the expense of attaching handles, the attachment to the pulley, and the like.

A major complaint with conventional starting systems is that they are prone to failure and expensive to repair. Servicing these systems oftentimes entails labor intensive operations and testing, as well as added expense in materials for parts of the mechanisms involved: rope, knotting, handles and pulley design. Design requirements specified for rope systems make them difficult to construct and do not allow for starting mechanism that afford a consistent, non-obstructive wind up or pull.

It would be desirable to provide an improvement to the conventional rope and pulley mechanisms, which would alleviate these problems.

SUMMARY OF THE INVENTION

The present invention provides a starting device having a strip, which is connected to the pulley of a pull start mechanism. In one embodiment, the strip is composed of a high performance polymer, such as nylon, preferably Capron® nylon 6 from Honeywell International Inc. and can be provided with an integral handle, such as by molding. Preferably, the strip is made by injection molding, extrusion or other methods from a high strength material. The strip is connected to the pulley by a connection means on its distal end. The strip is designed to fit neatly in a coil around a pulley hub.

More specifically, the invention provides a starting apparatus for internal combustion engines, comprising an elongated flexible starter strip provided with a handle on a first end and a connection means on a second end. A housing partially encloses the apparatus and is provided with an opening for receiving the starter strip. A receptacle, provided with a central hub and a post, is fixed within the housing. Rotatably positioned on the hub is a starter pulley provided with a channel for storing the starter strip. The pulley has one or more slots for securely receiving the connection means. When thus received, the first end of the starter strip is secured to the starter pulley and the elongated starter strip is wound around the starter pulley within the channel. A spirally wound spring having inner and outer ends are provided for rewinding the starter pulley. The spring is positioned within the receptacle with its inner end fixed to the pulley and its outer end fixed to the post. A ratcheting means is provided for connecting the pulley to the drive shaft of the internal combustion engine. The ratcheting means provides for uncoupled rotation between the pulley and the drive shaft when the pulley rotates in the opposite direction of normal drive shaft rotation. Coupled rotation between the pulley and the drive shaft is also provided by the ratcheting means when the pulley rotates in the direction of normal drive shaft rotation. With this arrangement, the handle is pulled causing the strip to unwind. The spring becomes wound and the pulley rotates, causing the ratchet means to engage the drive shaft and start the engine. Upon release of the strip, the spring unwinds, causing the strip to be rewound on the pulley.

The starting device of this invention provides an efficient pulley design since the starting strip lays flat and exerts substantially no lateral pressure against the walls of the pulley. When constructed from a high strength plastic material such Capron® nylon 6 resin from Honeywell International Inc., the strip lasts longer than a conventional starter rope. In addition, with such construction, the starter strip does not fray and affords a storing mechanism that is much cleaner than a conventional rope system.

Advantageously, the present starting device can have an integral pulley handle. With this feature, the device has fewer parts. It is easier to assemble, owing to the absence of attachment points typically required for actuation with rope or cords (which are usually knotted). Lateral pressure on the pulley is virtually eliminated. Conventional rope/pulley constructions can be replaced by lightweight, inexpensive rewinding devices that facilitate starting in an efficient, reliable manner. The propensity for snagging, wedging or knotting of the starter cord is replaced by a consistent, non-obstructive wind up or pull.

Rope breakage is eliminated. A constant grab and pull accompanies each starting attempt. Engine powered units can be redesigned into units that are smaller, lighter, less expensive, more efficient and much more reliable in operation.

BRIEF DESCRIPTION OF THE DRAWINGS

The invention will be more fully understood and further advantages will become apparent when reference is had to the following detailed description and the accompanying drawing in which.

DESCRIPTION OF THE PREFERRED EMBODIMENTS

The starting strip of this invention is formed from a material, which is somewhat flexible. Such material is typically formed by molding or extruding the strip from a thermoplastic material. A preferred material is composed of a high performance polymer, such as a nylon, preferably Capron® nylon 6 from Honeywell International Inc. The strip is provided with a distal end for connection to the starter pulley of a conventional small gasoline engine, and an opposite end, which is adapted to be grasped by the user when the engine is to be started. The opposite end is preferably provided with an integral handle that can be readily grasped by the user, and may be of any suitable shape. For example, the strip may have the form of a plastic wire or the like. Those having skill in the art will appreciate that instead of being integral with the strip, the handle can be comprised of a separate part.

Figure 1:
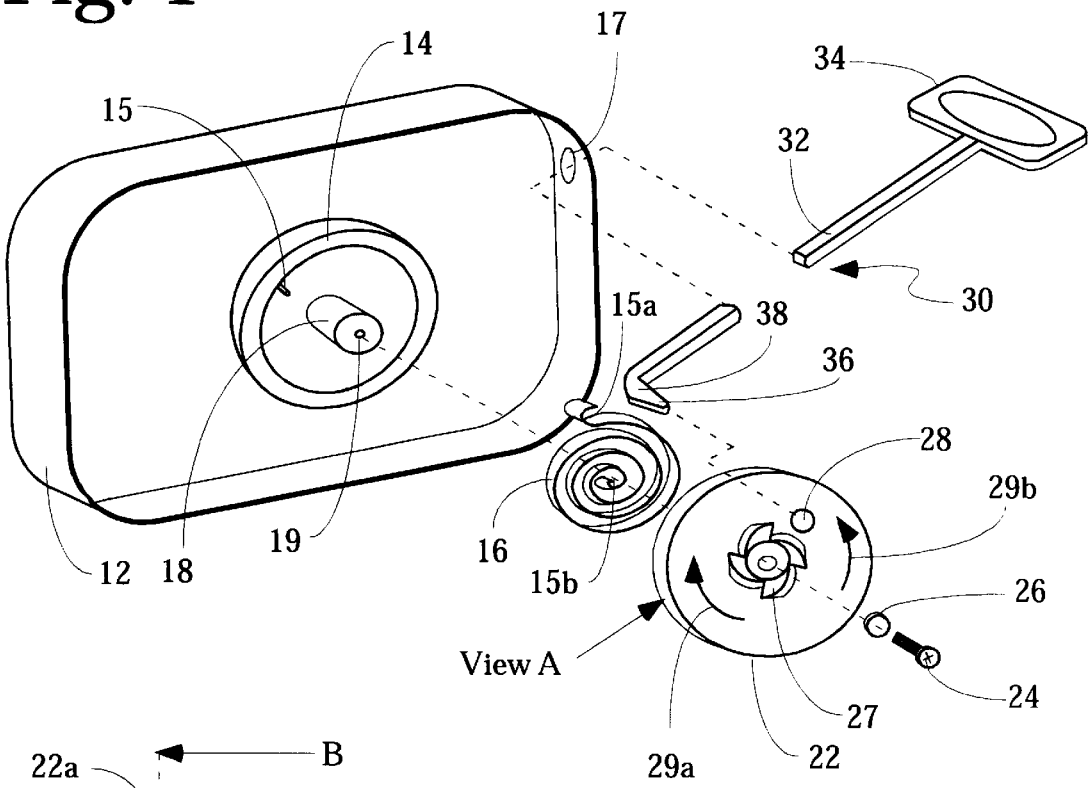
FIG. 1 is an exploded view of the starter mechanism of this invention.
Figure 1:
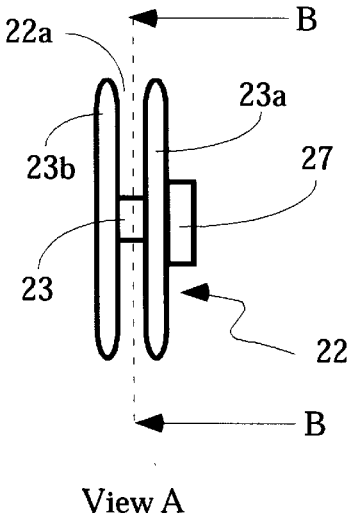
Figure 1:
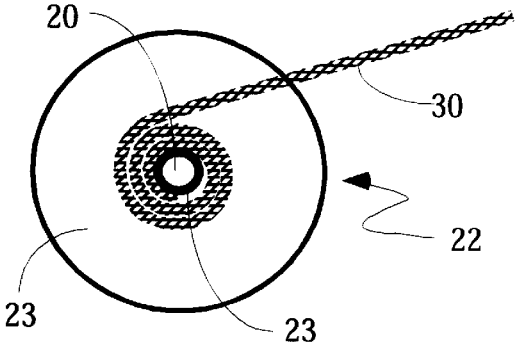

Referring to FIG. 1, the invention provides a starting apparatus for internal combustion engines comprising a starter strip 30 having an elongated flexible member 32 provided with a handle 34 on a first end and a connection means 38 on a second end. A housing 12 partially encloses the apparatus. Housing 12 is provided with an opening 17 for receiving the starter strip 30. A receptacle 14 is provided with a central hub 18 and a post 15. The receptacle 14 is fixed within the housing 12. A starter pulley 22 is rotatably positioned on the hub 18 and provided with a channel 22*a* for storing the starter strip 30. Pulley 22 has one or more slots 28 for securely receiving the connection means 38. The first end of the starter strip 30 is secured to the starter pulley 22 and the elongated starter strip 30 is wound around the starter pulley 22 within the channel 22*a*. In the aspect of the invention depicted in FIG. 1, a means for connecting strip 30 to pulley 22 is provided by engagement of tab 36 in slot 26 located in flange 23*a*. Spirally wound spring 16 has inner end 15*b* and outer end 15*a*. The spring 16 is positioned within the receptacle 14 for rewinding the starter pulley 22. Spring 16 has its inner end 15*b* fixed to the pulley 22 and its outer end 15*a* fixed to the post 15. A ratcheting means 27 connects the pulley 22 to the drive shaft of the internal combustion engine. The ratcheting 27 means provides for uncoupled rotation between the pulley 22 and the drive shaft when the pulley 22 rotates in the opposite direction 29*b* of normal drive shaft rotation. In addition, ratcheting means 27 provides for coupled rotation between the pulley 22 and the drive shaft when the pulley 22 rotates in the direction 29*a* of normal drive shaft rotation.

In operation, handle 34 is pulled causing strip 30 to unwind and rotate pulley 22. Ratchet means 27 is thereby caused to engage and rotate the drive shaft, starting the engine. Upon release of strip 30, spring 16 unwinds. Strip 30 is thereby rewound on pulley 22.

The starter strip 30 could be adapted for fast loading using a pre-designed bend as connection means 38. In this embodiment, tab 36 provides means for connecting strip 30 to pulley 22, as shown by FIG. 1. This embodiment of starter strip 30 eliminates the crimping, sticking and other failures of wind up cord units. Also eliminated is the effect of dirt settling into the pulley mechanism and failures due to abrasion caused thereby. Alternate means for connecting strip 30 to pulley 22 are shown in FIGS. 2*a*–2*d* and described in detail hereinafter.

This invention delivers a more consistent pull because strip 30 comes straight off of the pulley 22, rather than having to untangle itself from a developed nesting arrangement produced during winding of rope-type starting devices. The strip 30 has substantially uniform dimensions. It can be standardized and incorporated into a wide variety of engine units and products, all of which can be started thereby in an efficient, reliable manner.

Receptacle 14 has a central hub 18, which is provided with an opening 19 for receiving screw 24. Starter pulley 22 is disk shaped, comprising flanges 23*a* and 23*b* separated by hub 23. This arrangement forms channel 22*a* adapted for winding and storing strip 30. Hub 23 has opening 20 for receiving hub 18 of receptacle 14. In this manner, pulley 22 is free to rotate about hub 18. Pulley 22 is retained on hub 18 by means of a screw 24 and washer 26. The screw 24 is secured in opening 19 of hub 18 to thereby retain both the starter pulley 22 and spring 16 within housing 12. View A of FIG. 1 is a side view of pulley 22. View B is a cross-section side view of pulley 22 and a partially wound starter strip 30.

The starting mechanism described above with reference to FIG. 1 is a conventional spring-loaded mechanism. In accordance with another embodiment of the starting mechanism, one flange 23*a* or 23*b* of pulley 22 is provided with an attachment slot 28. Starter strip 30 has an elongated central portion 32, a handle 34 and a connection means 38. Each of handle 34 and connection means 38 can be integral with the central portion 32. Connection means 38 is provided with a generally L-shaped tab 36, which is adapted to be received in slot 28.

Starter pull strip 30 is formed of a flexible plastic material, such as nylon or other high strength material, by injection molding or other technique and shaped so as to fit neatly in a coil around hub 23 of pulley 22. In the embodiment shown, starter strip 30 is composed of a high performance polymer, such as a nylon, preferably Capron® nylon 6 from Honeywell International Inc. Starter strip 30 is appointed to be wound between flanges 23*a* and 23*b* of starter pulley 22, with tab 36 fitting into slot 28, as shown by phantom lines in FIG. 1. Strip 30 enters housing 12 through opening 17. To actuate the starting mechanism, starter strip 30 is placed in the position depicted by FIG. 1. Handle 34 is pulled to the right, as shown in the drawing. Such action causes rotation of starter pulley 22, which is attached to the engine drive shaft in a conventional way (not shown). Such rotary motion of pulley 22 is imparted to the drive shaft, starting the engine.

Handle 34 and tab 36 are shown herein to be integral components of starter pull strip 30. Such integral construction of the starter pull strip 30 is readily achieved by conventional forming operations, such as injection molding and the like. It will be appreciated by those skilled in the art that either or both of the handle 34 and tab 36 could comprise separate components that are attached by suitable fastening means to central portion 32 of pull strip 30.

Referring to FIGS. 2*a*–2*d* of the drawings, there are shown several alternatives for attaching central flexible member 32 of pull strip 30 to pulley 22. In a first of these alternatives depicted in FIG. 2*a,* connection means 38 is provided with a "T" shaped portion 40. In this aspect of the invention each of starter pulley flanges 23*a* and 23*b* have slotted openings (not shown). The "T" shaped portion 40 is adapted to fit into slotted openings of pulley flanges 23*a* and 23*b,* shown in FIG. 1.

Figure 2A:
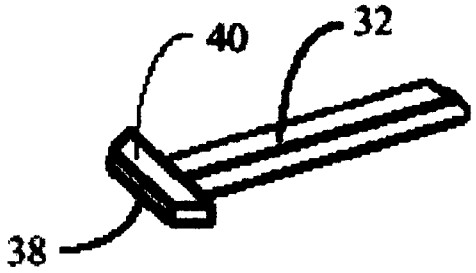
FIG. 2*a* is a perspective view of a first alternative connection means of the invention comprising a "T" shaped portion at the distal end of the starting strip for connection thereof to the starter mechanism.
Figure 2B:
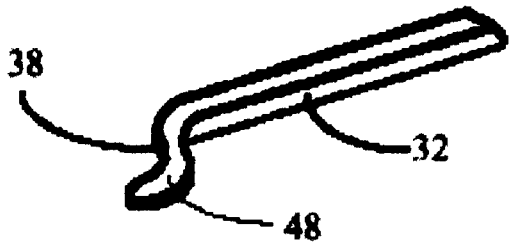
FIG. 2*b* is a perspective view of a second alternative connection means of the invention comprising a jogged tab portion at the distal end of the starting strip for connection thereof to the starter mechanism.

In a second alternative for attaching the member 32 to pulley 22 shown in FIG. 2*b,* jogged tab 48 of connection means 38 is adapted to be inserted into slot 28, shown in FIG. 1. It will be understood by the skilled worker that other attachment alternatives may be provided to connect strip 30 to pulley 22.

Figure 2C:
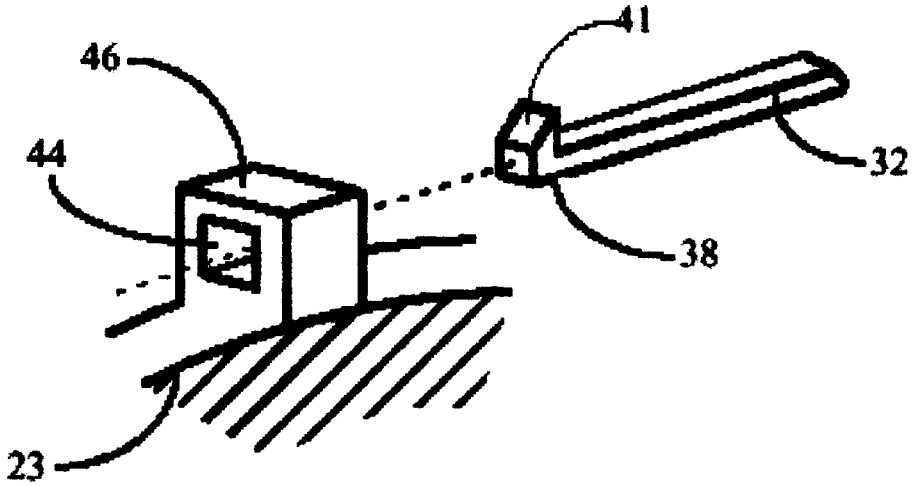
FIG. 2*c* is a perspective view of a third alternative connection means of the invention comprising a mold snap portion at the distal end of the starting strip and an extension of the hub of the pulley having a window appointed for receiving the mold snap portion.
Figure 2D:
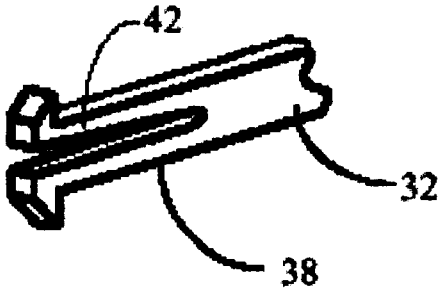
FIG. 2*d* is perspective view of a fourth alternative connection means of the invention comprising a forked shaped distal end of the starting strip formed of spaced tines for connection of the starting strip to the starter mechanism.

In a third attachment alternative shown in FIG. 2*c,* slot 28 takes the form of window 44 into which mold snap portion 41 of connection means 38 is adapted to be received. Hub 23 of pulley 22 has an extension 46 in which window 44 is provided. As illustrated in FIG. 2*d,* connection means 38 may alternatively be provided with a forked shaped end 42 formed of spaced tines adapted to be engaged in window 44.

As a fifth attachment alternative pull strip 30 is integrated with hub 23 of pulley 22 during molding to provide a single integrally molded part.

Figure 3:
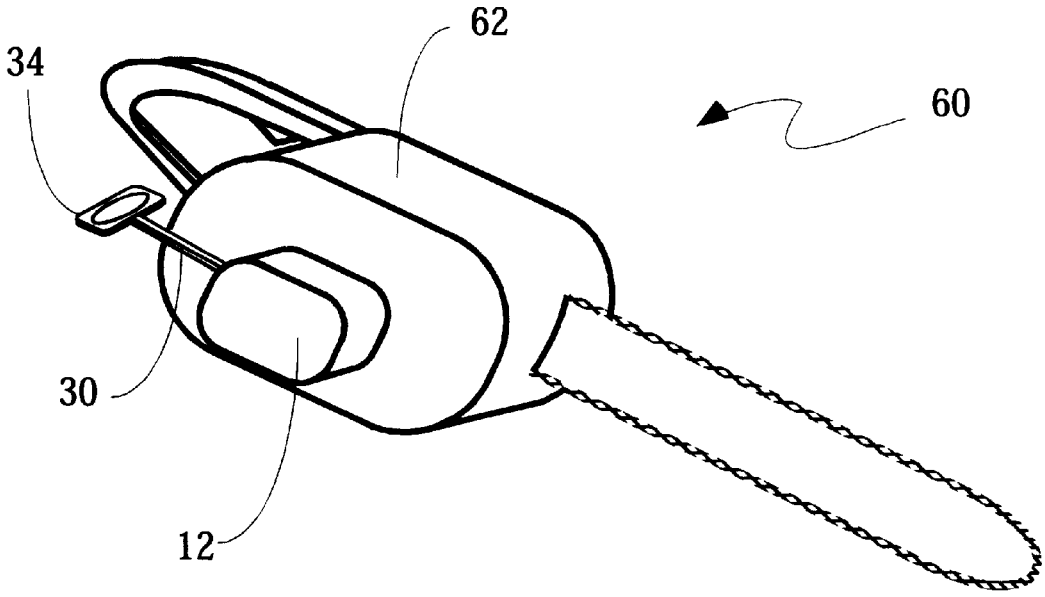
FIG. 3 is a view of the starter mechanism in a power chain saw.

Referring to FIG. 3 there is shown a portable chain saw 60. Chain saw 60 includes a housing 62 which encloses the engine, and a housing 12 which encloses the starter assembly. Starter strip 30 is pulled by handle 34 and unwinds the starter strip wound within housing 12.

The starting mechanism of the present invention can be used with a myriad of small engines. In addition to the power chain saw illustrated in FIG. 3, it may be utilized in a leaf blower, weed trimmer, and the like. The present invention is especially suited to be incorporated on most small engines in the same way that pulley and rope mechanisms are now provided. The entire system disclosed herein can be designed and adapted for use as part of a small engine unit.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A starting apparatus for an internal combustion engine having a drive shaft, comprising:

a. an elongated flexible starter strip having a handle on a first end and a connection means on a second end;

b. a housing partially enclosing said apparatus, said housing having an opening therein for receiving said starter strip;

c. a receptacle having a central hub and a post, said receptacle being fixed within said housing;

d. a starter pulley rotatably positioned on said hub and provided with a channel for storing said starter strip, said pulley having one or more slots for securely receiving said connection means, said first end of said starter strip being secured to said starter pulley and said elongated starter strip being wound around said starter pulley within said channel;

e. a spirally wound spring having inner and outer ends for rewinding said starter pulley, said spring being positioned within said receptacle and having said inner end fixed to said pulley and said outer end fixed to said post; and f. a ratcheting means for connecting said pulley to the drive shaft of said internal combustion engine, said ratcheting means being operative to produce uncoupled rotation between said pulley and said drive shaft when said pulley rotates in a direction opposite to a rotation direction extant during normal drive shaft rotation, and coupled rotation between said pulley and said drive shaft when said pulley rotates in said rotation direction extant during normal drive shaft rotation;

g. said handle, upon being pulled, unwinding said strip, thereby winding said spring and rotating said pulley, causing said ratchet means to engage said drive shaft and start said engine; and h. said spring unwinding upon release of said strip, causing said strip to be rewound on said pulley.

2. A starting apparatus as recited in claim 1, wherein said starter strip is composed of an injection molded high performance polymer.

3. A starting apparatus as recited in claim 2, wherein said polymer is composed of nylon.

4. A starting apparatus as recited in claim 3, wherein said nylon is nylon 6.

5. A starting apparatus as recited in claim 1, wherein said connection means comprises an L-shaped tab.

6. A starting apparatus recited in claim 1, wherein said connection means comprises a T-shaped tab.

7. A starting apparatus as recited in claim 1, wherein said connection means comprises a fork-shaped tab.

8. A starting apparatus as recited in claim 1, wherein said connection means comprises a jogged tab.

9. A starting apparatus as recited in claim 1, wherein said pulley has a flange thereon, and said slot of said pulley is located on said flange.

10. A starting apparatus as recited in claim 1, wherein said pulley has a hub thereon, and said slot is located on said hub.

11. A starting apparatus as recited in claim 1, wherein said pulley includes a hub comprising an extension having a window therein forming said slot, and said connection means comprises a mold snap portion adapted to be received in said window.

* * * * *